United States Patent [19]

Small

[11] 4,372,002

[45] Feb. 8, 1983

[54] COTTON TREATING PROCESS

[76] Inventor: Eugene D. Small, 1302 La Paloma St., Amarillo, Tex. 79106

[21] Appl. No.: 251,531

[22] PCT Filed: Oct. 17, 1980

[86] PCT No.: PCT/US80/01387

§ 371 Date: Oct. 17, 1980

§ 102(e) Date: Oct. 17, 1980

[87] PCT Pub. No.: WO82/01567

PCT Pub. Date: May 13, 1982

[51] Int. Cl.[3] ..... D06B 3/02

[52] U.S. Cl. ..... 8/156; 68/158; 68/175; 118/417; 427/372.2; 427/393.3; 427/430.1; 427/439; 366/300; 366/328

[58] Field of Search ..... 8/156, 159; 68/27, 53, 68/175, 181 R, 184, 210, 158; 427/372.2, 393.3, 430.1, 439; 118/417; 366/297, 298, 300, 328

[56] References Cited

U.S. PATENT DOCUMENTS 1,537,720 5/1925 White et al. ..... 68/158

3,332,258 7/1967 Schmitz ..... 68/158 X

FOREIGN PATENT DOCUMENTS 663126 10/1965 Belgium ..... 68/158

*Primary Examiner*—Philip R. Coe

*Attorney, Agent, or Firm*—Ely Silverman

[57] ABSTRACT

To impregnate loose cotton staple and like fibers with chemicals, a mass of such fibers is fed into and through a series of compartments in a baffled housing assembly and is there acted upon by a series of cooperating rotating paddle assemblies while in contact with a chemical containing aqueous liquor at room temperature and atmospheric pressure. The paddle assembly initially produces, with the liquid, turbulent columns of bubbles within each of the compartments, with the result that the cotton fibers are located in the thin walls between the bubbles. The paddles forming the paddle assemblies comprise thin rigid smooth flat sheets of expanded metal with a uniform array of sharp-edged holes therein and are arranged to pick up the frothy mass of cotton and water from the columns and then position the fibers in thin films of chemical-bearing liquor on the flat rapidly moving paddle surfaces and dewater the resulting extremely thin films, and knead the fibers individually by impacting and/or massaging actions and thereby impregnate the lumen of each of such fibers with such liquor and thereby permanently locate such chemicals within such fibers.

8 Claims, 14 Drawing Figures

COTTON TREATING PROCESS

TECHNICAL FIELD

My invention relates to treating cotton staple to impregnate such and like fibers with chemicals. The process and apparatus quickly and thoroughly impregnates cotton and like fibers with chemicals.

BACKGROUND ART

Conventional methods of chemically treating fibers as in U.S. Pat. Nos. 1,635,865 and 2,868,005 and the currently made PETRIE/Wira Wool Scourer treat a mass of fibers by impacting such mass with impellers in a mass of liquid to drive fibers into the liquid while this process and apparatus provide for treating individual fibers by kneading actions on individual fibers while separated from the remainder of the mass of fibers and thus drive liquid into fibers and so impregnate such fibers with chemical-containing liquors.

DISCLOSURE OF INVENTION

The process provides for mixing fibers with chemical-bearing liquor, positioning the fibers in extremely thin films, arranging such thin films on flat support surfaces, dewatering the resulting thin films and thereafter kneading such fibers to impregnate the lumen of such fibers with liquor. Such operation rapidly locates the chemical bearing liquor within the fiber, whereby such chemicals are more permanently located within such fiber than by processes using only the exterior surface of the fiber. The apparatus and process also provide a momentum and impact action on the exterior surface of the treated fibers that enhances the absorption of liquid into such fibers.

BEST MODE FOR CARRYING OUT THE INVENTION

Figure 1:
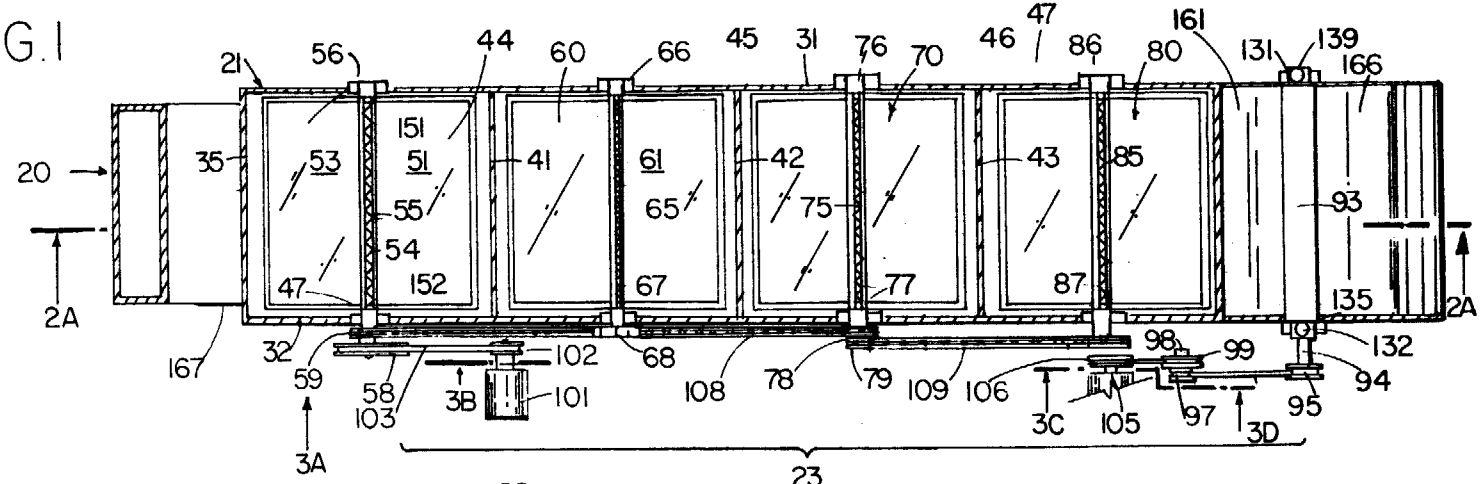
FIG. 1 is a plan view along the section 1A—1A of FIG. 2, of aparatus 20 at rest and empty.

The apparatus 20 comprises a housing assembly 21, a paddle assembly 22, a roller assembly 24 and a drive assembly 23 on a base 159. Housing assembly 21, power assembly 23 and discharge roller assembly 24 are firmly attached to a rigid base 159 which rest on the ground 158. Paddle assembly 22 is supported in housing assembly 21. Power assembly 23 is operatively attached to and drives the paddle assembly 22 and parts of the discharge roller assembly 24. The frame 159 firmly locates the housing assembly 21 relative to the drive assembly and the roller assembly.

In operation a mass of cotton fibers is fed into the housing assembly and is acted upon by the paddle assembly and the discharge roller assembly 24.

Figure 2:
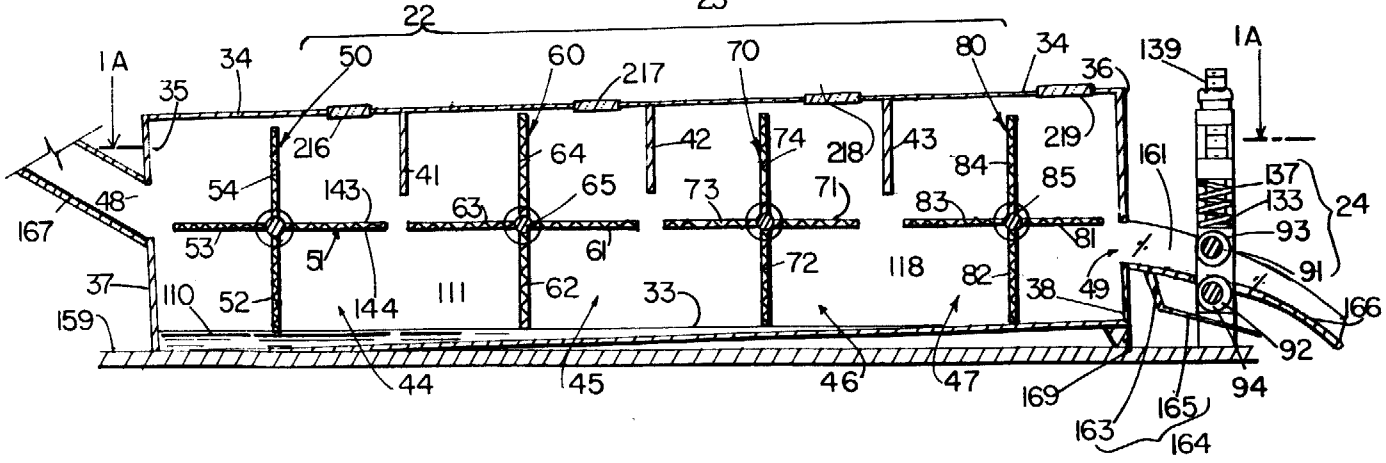
FIG. 2 is a vertical longitudinal sectional view, along Section 2A—2A of FIG. 1, of apparatus 20 when at rest.

The housing assembly comprises, in operative combination, a vertical longitudinally extending left side housing panel 31, a vertical longitudinally extending right side housing panel 32, a floor panel 33, a roof panel 34, vertical feed end panels 35 and 37, vertical discharge panels 36 and 38 and chutes 161, 163, 166 and 167. Panels 31-38 are rectangular in shape and imperforate and rigid. These panels are firmly joined together at their edges to form a rigid housing chamber 40 that is rectangular in vertical longitudinal section, as shown in FIG. 2 and in horizontal transverse section, as shown in FIG. 1, as well as in vertical transverse section.

The housing assembly 21 encloses a housing chamber 40. The housing chamber 40 has a horizontal rectangular housing inlet or feed opening 48 located and extending between the horizontally extending bottom edge of top feed end panel, 35, and the horizontally and transversely extending top edge of the lower feed end panel, 37, and extends between housing side panels 31 and 32 feed chute 167 opens to inlet 48.

Housing chamber 40 has a rectangular, horizontally extending housing outlet or discharge opening 49 located and extending between the horizontally and transversely extending bottom edge of top discharge end panel 36 and the horizontally and transversely extending top edge of the bottom discharge end panel 38 and extends from housing side panel 31 to housing side panel 32.

Baffles 41-43 are located within the housing chamber 40. A first, feed end, vertical transverse baffle 41 is parellel to and spaced rearwardly of the feed end panels, a third rear vertical transverse baffle 43 is located parallel to and spaced forwardly of the discharge end panel 36 and an intermediate vertical transverse baffle 42 is located forwardly of the panel 42 and parallel to and rearwardly of the feed end baffle 41.

Each of the baffles 41-43 is a rigid imperforate panel that extends from and is firmly attached to the roof 34 and extends laterally from the left side panel 31 to the right side panel 32 and is firmly attached to both and has a lower free edge, as 116, 117 and 118 respectively. Those lower edges extend downwardly from the roof to a vertical level slightly above the level of a plane passing through the axles of the paddles of paddle assembly. The baffles 41, 42 and 43 divide the chamber 40 into a first, or feed end compartment, 44, a front intermediate compartment, 45, and a rear intermediate compartment, 46, and a discharge compartment, 47. The side walls 31 and 32 preferably include transparent side windows as 190-199 and the roof 33 preferably includes transparent roof windows as 216-219; such windows made of shatterproof glass or made of rigid transparent material such as LUCITE® (duPont trademark for methyl methacrylate) to allow visual observation from outside of housing 40 of the operation occurring within each of the housing compartments 44-47.

The paddle assembly 22 comprises four like paddle sub-assemblies, 50,60,70 and 80 that are structurally identical. Each of the paddle sub-assemblies 50, 60, 70 and 80 comprises a plurality of four like rigid paddles.

The first paddle sub-assembly 50 comprises a first paddle 51, a second paddle 52, a third paddle 53 and a fourth paddle 54 and an axle 55. Each paddle as 51 comprises a rigid rectangular peripheral frame as 141 and a rigid foramenous plate as 142. Plate 142 is formed of a thin yet rigid sheet 140 of expanded metal which sheet is flat and smooth on its top and on its bottom surfaces (143 and 144) and has a uniform array of like sized and shaped sharp-edged hexagon-shaped holes therein, as 145. Each of the holes as 145 pass entirely through the sheet 140 from top to bottom surface thereof. Each of such holes has a greater length (146) than width (147). The maximum width of each panel hole is one-half the thickness of the adjacent solid portion as 148, of the expanded sheet. Two-thirds of the total area of the sheet 140 is accordingly occupied by metal and the remaining portion of the total area encompassed between central, peripheral and lateral edges of that plate 142 is empty. The plate 142 is firmly connected at its central edge, 151, peripheral edge, 152, left lateral edge, 153, and right lateral edge 154 to the frame 141. Each of the paddles extends radially from and is firmly fixed to a straight rigid first axle 55. The axle 55 is rotatably supported in a left bearing 56 in the left side housing panel 31 and in a right bearing 57 in the right side housing panel 32. The first axle 55 is firmly attached to and supports a driven V-belt pulley 58 and, also, a first drive sprocket gear 59 which drives a chain 108.

The second paddle sub-assembly 60 comprises like paddles 61, 62, 63 and 64, each like paddle 51 in size and structure, and each extending radially from a straight rigid second axle 65 and firmly attached thereto. Second axle 65 is rotatably supported in left bearing 66 and right bearing 67 in side panels 31 and 32 respectively and that axle is firmly attached to and supports a second driven sprocket gear 68 exterior the right side housing panel driven by chain 108. The third paddle sub-assembly 70 comprises four like paddles 71, 72, 73 and 74, each like paddle 51 in size and structure, and extending radially from a central rigid straight second axle 75 and firmly attached thereto. The second axle 75 is rotatably supported in left bearing 76 and right bearing 77 in the left side housing panel 31 and the right side housing panel 32 respectively.

Exterior to the right side wall third axle 75 is firmly attached to and supports a driven gear 78 and a drive gear 79 for attachment to chains 108 and 109 respectively.

The fourth paddle sub-assembly 80 comprises a set of four like paddles 81, 82, 83 and 84, each like paddle 51 in size and structure, and firmly attached to a straight rigid fourth axle 85. Axle 85 is rotatably supported in a left bearing 86 and a right bearing 87, respectively, located in the left and right side housing panel walls 31 and 32. The fourth axle is firmly attached to and supports a fourth driven gear 88 which is located on the right hand side of the axle 85 exterior to the right housing panel wall 32 driven by chain 109. Each of the paddle assemblies 50, 60, 70, and 80 rotate about an axis of rotation passing through the axle therefor as 55, 65, 75, and 85. Roller assembly 24 comprises rollers 91 and 92 and frames 131 and 132 therefor: top discharge roller 91 and bottom discharge roller 92 are cylindrical and parallel and adjacent to each other and both extend transversely from laterally of the plane of left side housing panel 31 to laterally of the plane of the right side of the housing panel 32 and are located near the housing discharge opening 49 and bottom rollers are cylindrical and are co-axial with and fixed to rigid straight top and bottom roller axles 93 and 94 therefor respectively. Those axles are rotatably supported in bearings therefor in the left and right side journal frames 131 and 132. Like rigid left and right side journal frames 131 and 132 are firmly fixed to rigid frame 159 to which housing 40 attaches. Two like top discharge roller journals 133 and 134, are resiliently and yieldably vertically movably located in frames 131 and 132 and rotatably support top discharge roller axle 93; two like bottom discharge roller journals 135 and 136 are firmly located in frames 131 and 132 and rotatably support bottom discharge roller axle 94. Each of left and right side journal springs 137 and 138 is fixed at one upper end to a journal frame as 131 and 132 and at a lower end to a movable journal as 133 and 134 respectively.

The drive assembly 23 comprises motors 101 and 105 and belts and chains and pulleys and sprocket gears 59, 68, 78, 79, 88, and 95–99 and 108 and 109 attached thereto.

A motor 101 drives a drive pulley 102 which in turn drives a drive belt 103 which drives the pulley wheel 58 of shaft 55 of paddle sub-assembly 50. A secondary motor 105 operates a drive pulley 106 drives a pulley 99; pulley 99 drives a shaft 98 and smaller pulley 97; pulley 97 drives a V-belt 96 which drives the drive pulley 95 for roller 94. Motors 101 and 105 are firmly fixed to frame 159.

Figure 3:
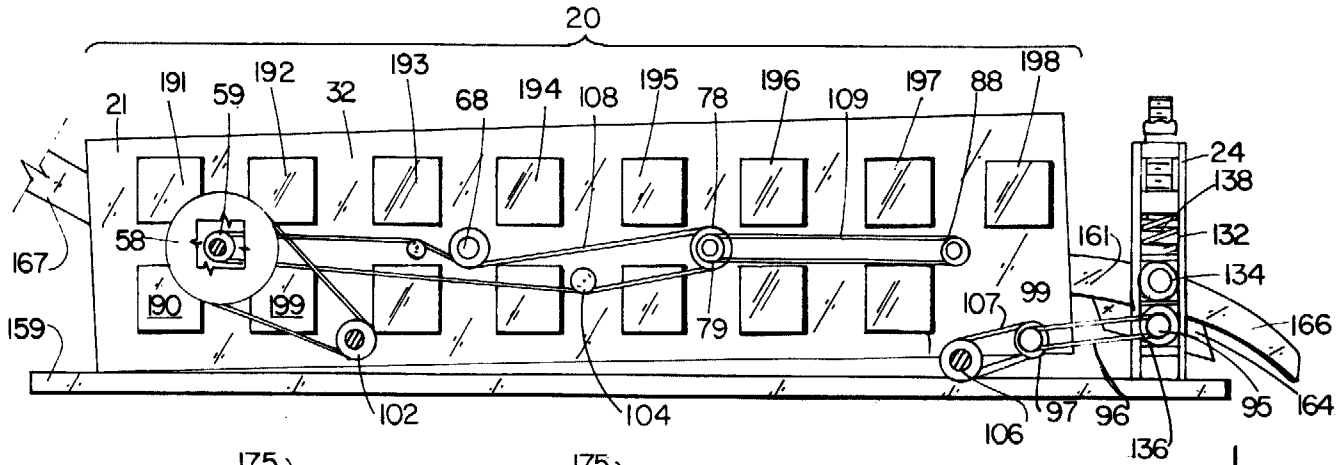
FIG. 3 is a side view of apparatus 20 along the direction of arrow 3A of FIG. 1 and partly broken away along section 3B-3C-3D.

A main discharge chute 161 is a smooth imperforate plate; it attaches to and extends downwardly and forwardly (rightwards as shown in FIGS. 1–3) from the upper transverse horizontal edge of bottom discharge end panel 38. The forward edge of chute 161 is adjacent the top edge of lower roller 92 and forward (leftward as shown in FIGS. 1–3) of the line of contact of the rollers 91 and 92. A rear wall 163 of supplementary water chute 164 extends downward from chute 161 and is attached thereto between roller 92 and bottom discharge end panel 38. A water chute floor 165 extends forwardly of and is attached to bottom of water chute wall 163 and extends forwardly below and out of contact with roller 92.

A fiber discharge extension chute 166 extends forwardly of roller 92. Extension chute 166 has a straight rear edge thereof closely adjacent to roller 92 adjacent to the line of contact therewith with roller 91. Journal frames 131 and 132 and chutes 161, 164 and 166 are supported firmly on frame 159, as also is housing assembly 21.

In operation of apparatus 20 motor 101 drives pulleys 58, 78 and 88 in a counterclockwise direction (as seen looking in direction of arrow 3A of FIG. 1) and concurrently drives paddle assembly 60 in the clockwise direction (as seen in direction of arrow 3A of FIG. 1).

Assemblies 70 and 80 are driven at the same angular rotation speed; assembly 70 is driven at 17/21 of angular rotation speed of assembly 50; assembly 60 is driven at the same angular rotation speed as assembly 50 but in the opposite direction of rotation.

Figure 4:
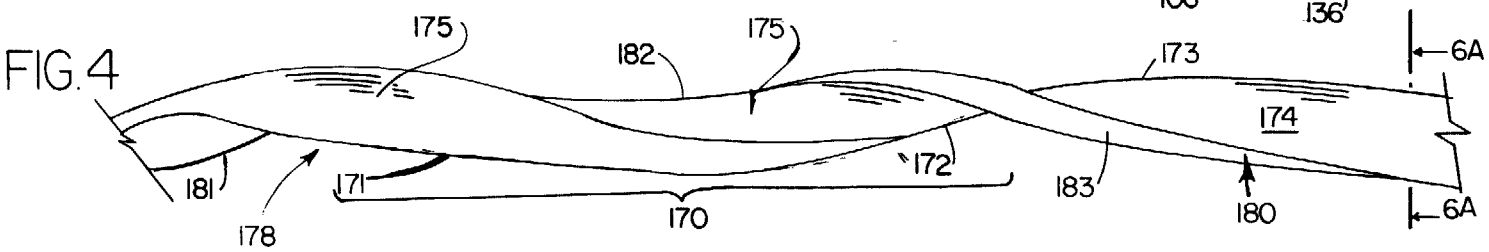
FIG. 4 is an enlarged showing of a typical fiber portion as portion 4A of FIG. 5, and is to scale.
Figure 6:
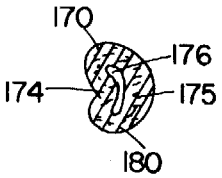
FIG. 6 is a transverse enlarged view along section 6A—6A of FIG. 4 to show the structure of the fiber internally.
Figure 5:
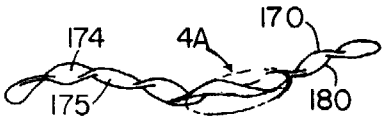
FIG. 5 is a diagrammatic perspective view of a fiber showing the reversals of the spiral pattern therein.

The mass of fibers fed into the chamber 40 have a bulk density of 0.9 pounds per cu. ft. (14.4 grams per liter). Each fiber as 178 in such mass have walls as 174 and 175 with spirally arrayed edges 170 and 180 and a lumen 176 encompassed by such walls and edges. As shown in FIGS. 4–6 each fiber is twisted, hollow and flattened and the lumen is also flattened. The successive adjacent portions as 171, 172, and 173 of one fiber edge as 170 form a spiral about the other adjacent successive portions of the edge as 181, 182, and 183 of the other edge as 180 while the relatively flattened surfaces as 174 and 175 extend between the edges 170 and 180. The walls 174 and 175 have an average width between edge 170 and 180 of 0.025±0.005 mm (0.001 inch) between edges 170 and 180 and a thickness of 0.005±0.001 mm (0.0002 inches) across the surfaces as 174 and 175 for an average diameter of 19 microns. Fiber 178 has a twist of 180° in 0.08 mm (0.003 inches) length of fiber. The fibers in the mass of staple are ⅛ to 1⅛ inches long (2.54±0.2 cm). Apparatus 20 mixes such fibers with chemical-bearing liquor, positions the fibers in extremely thin films, arranges such thin films on flat support surfaces, dewaters the resulting thin films and kneads the fibers in those thin films against rigid surfaces to impregnate the lumen of such fibers with chemical-bearing liquor whereby such chemicals are permanently located within such fibers.

In operation of apparatus 20, raw combed cotton is fed at a steady uniform rate of 600 pounds (272 kg.) per hour at room temperatures (60°-80° F., 15°-27° C.) at normal atmospheric pressures (14.7±0.5 psia., 760±25 mm. Hg) into feed opening 48. Water is fed at the rate of 1 pound per second and a mass of water 110 is maintained at the bottom of chamber 40 such that, at rest condition of the paddles, such body of water has a volume of 10 gallons (37.85 liters) to 15 gallons (56.8 liters): such volume provides, at rest, at the feed end, near the lower front panel 37, a height of liquid of 2 inches (5.1 centimeters) per 10 gallons and 3 inches (7.6 centimeters) for 15 gallons (56.8 liters) within the chamber 40, as the floor 33 of the housing 21 is tilted slightly upward (2.5 inches 6.3 centimeters) by foot 169 over the height of the feed end of the housing. Such added water and cotton form a mixture of cotton and water.

The axles 55, 75 and 85 are rotated at 750 r.p.m. which provides 3,000 impacts per minutes on the top surface 111 of the body of water 110 in each of compartments 44, 45, 46 and 47, or 50 strokes per second on the surface of the body of water in each of those compartments 44, 46 and 47. Axle 65 rotates at 2,430 r.p.m. with a consequent reduction in the number of impacts on top surface of the body of water in chamber 45 relative to compartments 44, 46 and 47.

In the overall the action of the paddle assemblies 50, 60, 70 and 80 on the water suspension of cotton fibers provides a turbulent column of bubbles within each of the compartments 44, 45, 46 and 47. Such columns, although agitated, position the cotton fibers in the thin walls between such bubbles and such turbulent columns arranges the cotton fibers in a multiplicity of extremely thin layers of fibers within the walls between the bubbles. The paddles of the paddle assembly engage and pick up the frothy mass of water and cotton. The orifices in the foraminous flat paddle plate as 142 provides that water in such froth and axially directed fibers rapidly pass out through the holes as 145 in such foraminous plates leaving a very thin layer of water and radially directed fibers spread out on each paddle plate as 142. While each rotating paddle surface as 143 is moist it has an extremely small thickness (less than 1/16 of an inch of liquid) in contact with the paddle surface. The paddle surface moves in the direction in which the upper surface (as 143) faces.

The longer (16 mm) dimension of the holes as 145 in all plates as 142 of all the assemblies 50, 60, 70 and 80 extend parallel to the axle, as 55, of each paddle assembly while the shorter (2 mm in the preferred embodiment) width of such holes as 145 is transverse to such axle. Hence, in operation of apparatus 20, with water draining from those holes, such holes impede radial passage of fibers which extend parallel to the longitudinal axis of the paddle assembly axle, as 55, and cause such fibers as remain on that paddle to become oriented with their length normal or perpendicular to the paddle assembly axle. Such structure of the paddle also permits the fibers which extend normal to the longitudinal axes of the axles and which fibers are longer than the (2 mm) width of the holes, to move radially rapidly. Accordingly the fibers that extend radially along the surfaces of the paddles move in a direction perpendicular to the axles of such paddle assembly and the axis of rotation of such paddle assembly. Also, during movement of the fibers through the air of the chamber after such fibers leave the surface of the paddles the air minimally impedes passage of the fibers that are traveling in a direction parallel to their length, whereby the fibers that pass from the surface of the paddles to reach the rigid surface of the baffles as 41-44 or roof 34 are those traveling in directions parallel to the length of direction of such fibers. These fibers are only about 1 inch long; each paddle surface is 11 inches wide from the axle to the peripheral edge (as 152) of each paddle (51-54, 61-64, 71-74 and 81-84).

Under the influence of the centrifugal force acting on each of the fibers located on the slippery surface of the flat paddles, each of the fibers in the thin layer of oriented fibers rapidly moves along the flat smooth surface of each of the plates of the paddles and is forcefully impelled radially and projected against a rigid surface such as baffles 41-43 or the roof 34 along a path as 210.

Figure 9:
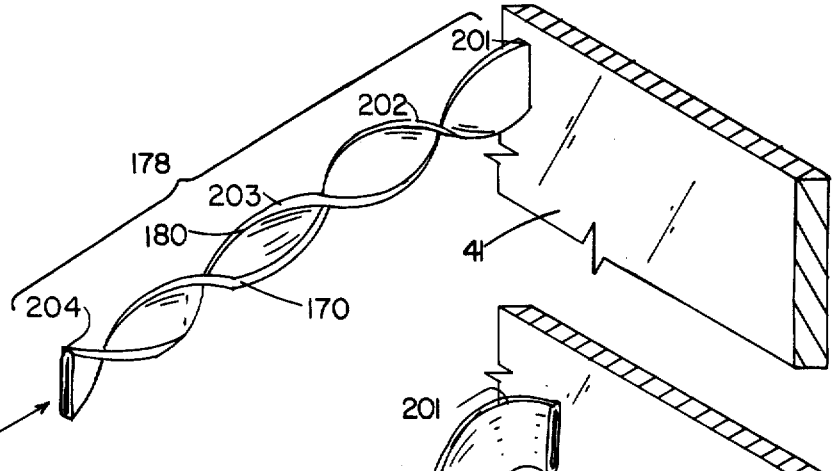
FIGS. 9-11 and 12-14 are diagrammatic views of kneading action on single fibers 187 and 207 respectively during operation of the apparatus 20.
Figure 10:
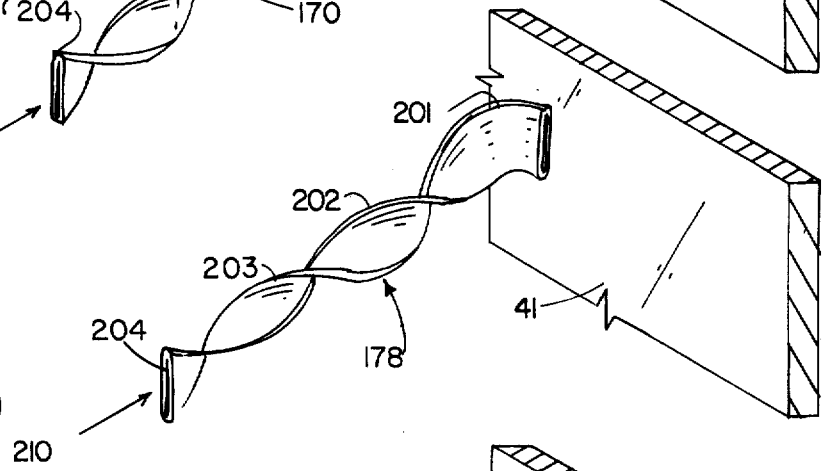
Figure 11:
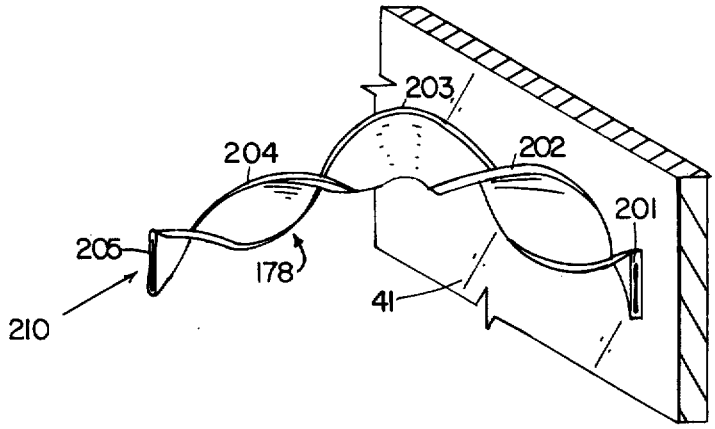

The portions as 201 of the individual cotton fibers as 178 first impelled against a rigid surface as of the baffles such as 41-43 are deformed as shown in FIGS. 9-11 because the steps of arranging the fibers in thin films, dewatering the film and orienting the fibers on the paddles provide for a treatment of each fiber separately beginning at one end. As diagrammatically shown in FIGS. 9-11 each water-soaked fiber as 178 is impelled toward a smooth wet rigid stationary surface, as the roof 34 or a vertical baffle as 41. The end portion, as 201 of a fiber as 178 which makes first contact with such rigid surface (as the vertical surface of the plate 41) bends to one side or another and thereafter successive portions as 202-205, initially rearward of the initially most forward portion (201) are successively bent as the momentum of the fiber moves that flexible fiber against the rigid plate. Each fiber is thus separately treated and in such treatment the point of impact of each fiber and baffle or roof changes with time as the impacting portion of the fiber is successively moved along the length of such fiber as from zone 201 to zone 202 to zone 203 to zones 204, to zone 205 as shown diagrammatically in FIGS. 9-11. By such massaging or kneading action of each fiber individually the liquid in the lumen of each of such hollow fibers is moved along the otherwise collapsed lumen of the tube while the fiber adheres to the wetted wall (as baffles 41-43) or roof (34); then the water-laden fibers fall downward along the wetted vertical wall of baffle 41 and then fall through the low density structure formed by the thin-walled foam and are carried by the flow of fluid created by action of paddle assemblies 50, 70 and 80. The repeated action of this nature, kneading the fibers and moving the liquid in the lumen of the fiber initially near the end of the fiber toward the center of the fiber locates a solution of fire retardant, such as a solution of borax 7 parts and boric acid 3 parts and water 64 parts, well inside the lumen of each fiber.

Additionally, impact action between the wetted walls that are rigid and the projected surface of the fiber produces high pressure impregnation of liquor into such fiber wall from the exterior thereof.

In overall, in the chamber 40 the action of the rotating paddles of the sub-assembly 50 mixes water and the feed in first chamber 44. Thereafter, in the lower left-hand quadrant of chamber 45 (lower left-hand as viewed in direction of arrow 3A and as illustrated in FIG. 2) the flow of liquid suspension caused by the clockwise motion of the paddle assembly 60 inhibits flow rightwards (as shown in FIGS. 2 and 3) from the chamber 44. In all of compartments 44–47 the heavier material comprising the water-soaked fibers sink closest to the floor 33 while the lighter material is caught and repeatedly treated in those compartments by the rotating paddles.

On each of the paddles not only is there a dewatering on the flat upwardly moving surface of each panel but also, the earlier impregnated and swollen fibers remain in positions closer to axles as 55, 65, 75 and 85 than to the peripheral portion (as 152) of the frame of each paddle while the more twisted portion of each fiber move more readily to a position closer to the frame peripheral portion as 152 of frame 141 so that the impelling action created by rotation of the paddle assembly on which the thin layer of fibers is supported provides a selective orientation of the fibers on the paddle with the more twisted of the fibers in a more radial or peripheral direction and the less twisted or more rounded fibers in the more central portion of such radially moving fibers inasmuch as the addition of water to each portion of the lumen of each fiber as 178 swells such portion of the fiber and transforms that originally flattened portion of that fiber to a more rounded shape as seen in transverse section. The rounded fiber shape of the fiber portion so provided results in a greater surface area per unit length of such portion of that fiber. Such added surface area and more rounded shape results in a greater adhesion of the water on the surface of the paddles to the separate swollen or rounded portion of the fiber; accordingly, during the radial motion of such fiber (moving) radially along a paddle surface as 143 such added surface area and rounded shape results in the paddle surface selectively holding such rounded fibers by surface tension of the water adjacent and adherent to both the paddle surface and the fiber while the narrower portion of the fiber moves radially and, being in a radial position, such narrow portion is subsequently selectively impacted against the hard baffle or roof surface while the already impregnated portions of the fibers follow such radial portion and are not so treated; accordingly, an aspect of the operation of the apparatus 20 and process is that such apparatus and process provides a series of successive selective treatments to each of the untreated or unimpregnated fiber portions to provide a uniform total treatment of all of the fibers fed to apparatus 20.

In compartment 47 the paddles sweep the liquor and the fibers suspended in the liquor toward the discharge opening 49 of the chamber 40 and so maintain the level of the liquid in chamber 40 at such a low level that the formation of frothy mass in the first compartment 44 and second compartment 45 is not impeded by the level of liquor being so high in those compartments as to impede the froth-making action. The action of the paddles in the terminal compartment 47 is sufficiently rapid that it does not permit slugs of fibers to develop in the first compartment 44 as there is such a short lag time—usually only 6 seconds—between the removal action in compartment 47 and the addition of feed to the first compartment 44 The treated fibers provided by action in the compartment 40 pass to the chute 161 and therefrom to the rollers 91 and 92 whereat such treated fibers are subjected to a wringing action. The water resulting from such wringing action is passed to the chute 164 while the moist fibers are passed to the discharge chute 166.

The above described projection of individual fibers against a neighboring rigid panel wall along a path as 210, (which projection is above described principally in terms of referent numbers of paddle assembly 50) occurs also and principally at paddle assemblies 60, 70 and 80 against the adjacent rigid baffles as 41, 42 and 43 (as shown in FIGS. 9–11 for baffle 41) and roof 34.

Figure 12:
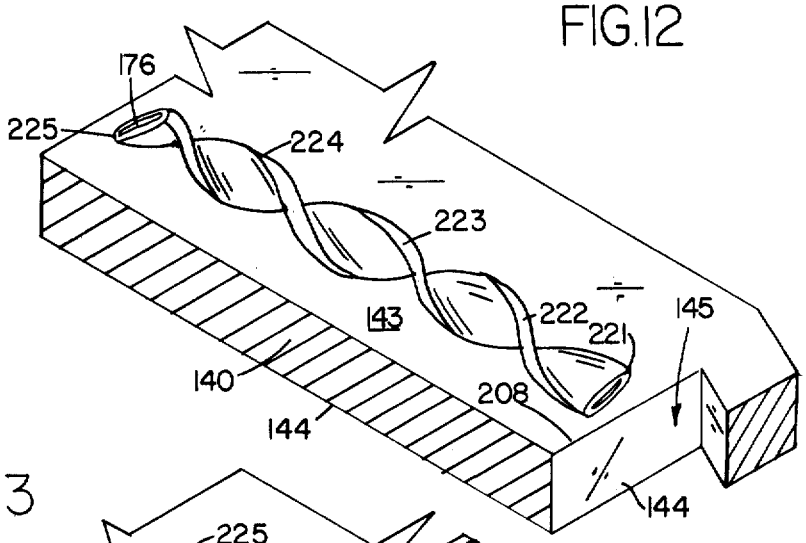
Figure 13:
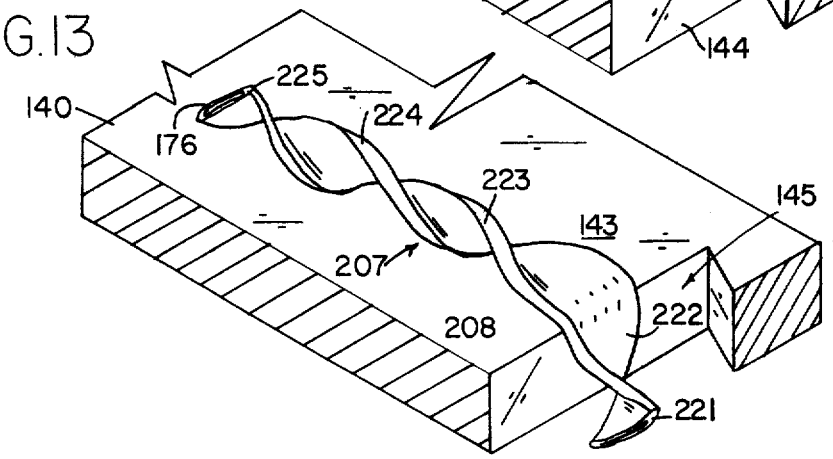
Figure 14:
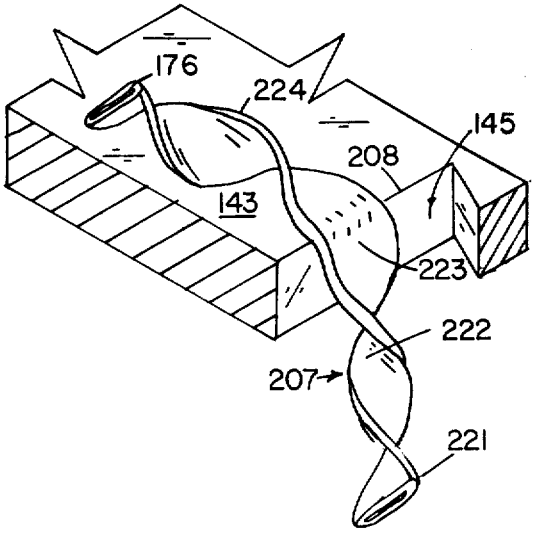

The kneading action of apparatus 20 kneads the fibers initially in the thin films on the flat support surfaces provided by the paddle surfaces of assembly 20 not only by (a) the above described procedure of orienting the fibers initially in thin films and projecting such oriented separate fibers from the support surfaces (as panels of the paddles as 51–54 and 61–64 and 71–74 and 81–84) against the rigid surfaces as of baffles 41–43 and roof 34 for impact action to knead and thereby impregnate the lumen of such fibers with chemical-bearing liquor, as illustrated in FIGS. 9–11, but also (b) by the procedure of kneading the flat spirally shaped fibers while in thin films on the panels of the paddles so as to impregnate the lumen of such fibers with chemical-bearing liquors as shown in FIGS. 12–14, which are diagrammatic views of deformation of a single fiber 287 during its passage along an edge of an orifice, 145, in the paddle plate during operation of the apparatus 20.

Figure 7:
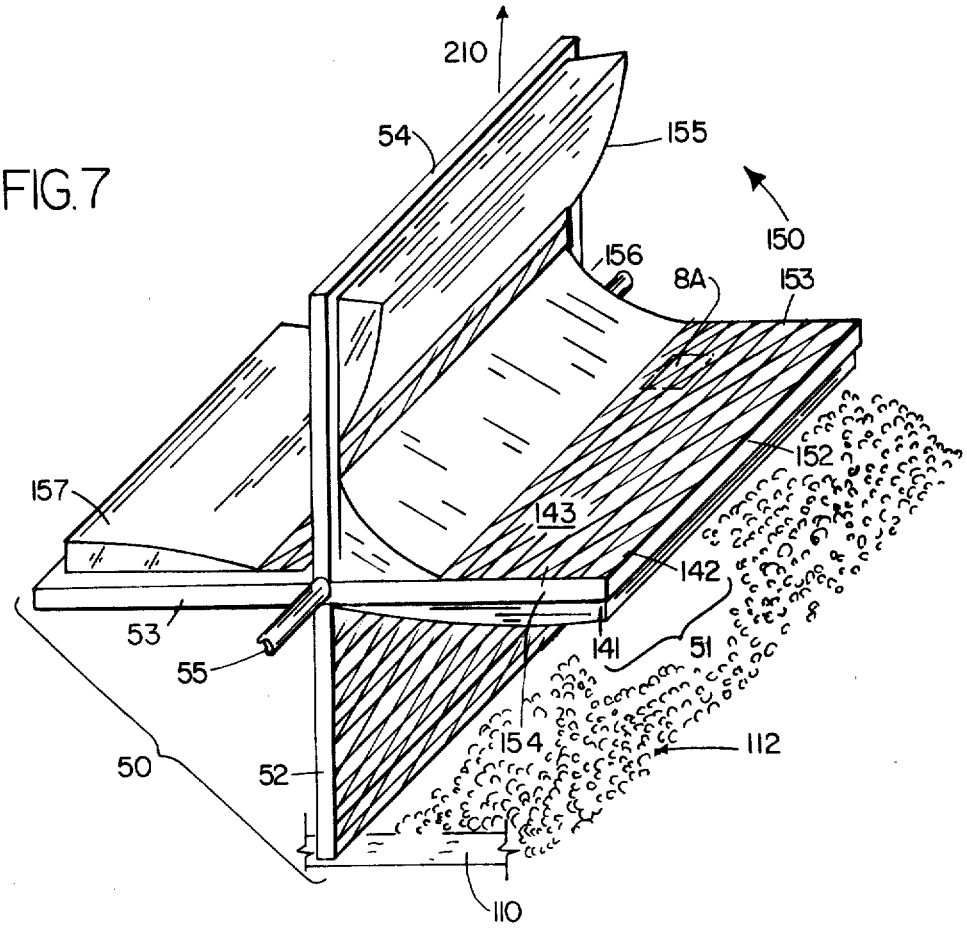
FIG. 7 is a diagrammatic perspective view of paddle assembly 50 during operation of the apparatus 20.
Figure 8:
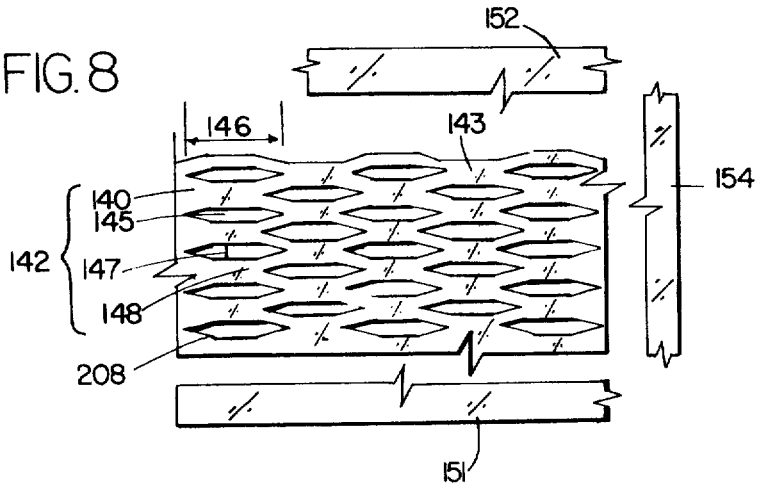
FIG. 8 is a diagrammatic scale view of zone 8A of FIG. 7 to show detail of the paddle plate structure.

More particularly, concurrent with (a) the above-described radial movement of fibers away from the axles as 55, 65, 75, and 85 on each of the paddle assemblies as 50, 60, 70 and 80, respectively, toward the peripheral portion of each paddle (as peripheral portion 152) for kneading of the fibers by impacting of the fibers against baffles and roof during operation of apparatus 20, (b) a frothy mass of water 156 is carried between upwardly extending paddles as 54 and 51 above axle as 55 (and between paddles of assemblies 60, 70 and 80 above the axles 65, 75 and 85) even though the upper level 110 of water at rest is far below the vertical height of the axles 55, 65, 75 and 85. Such accumulations above axles 55, 65, 75 and 85 are especially noticed during the orientation of such paddles when a paddle as 54 extends upward and to the left (as shown in FIGS. 1 and 7) and paddle 51 extends upward and to the right. Such accumulations may be observed, notwithstanding the rapid rate of the rotation of the paddle assemblies, by a stroboscopic light repeatedly flashing for uniform periods of 1/25,000 second with uniform intervals of 1/30 second between such periods during such operation. In operation of apparatus 20, as shown in FIG. 7 for assembly 50, rotating in direction 150, water streams as sprays (as 156 and 157) from the rear surface (rear in sense of being the rear portion of the paddle surface that moves forward in direction faced by the paddle forward surface) of each rotating paddle (as 54 and 53 respectively) of all paddle assemblies 60, 70 and 80 as well as shown in FIG. 7 for assembly 50. Such sprays are formed of a multiplicity of streams. Each of such streams is formed from water which passes through one of the many holes as 145 (which are evenly distributed or arrayed in sheets as 142). Such streams of water that pass through the holes as 145 carry the fibers in the thin films carried on the plates as 143 past the edges of the holes as 145.

Generally, as illustrated in FIGS. 12–14, when each fiber, as 207, that had theretofore reached the forward surfaces, as 143, of the paddle plates (by such paddles engaging the frothy mass of bubbles in chambers 44–47 and causing the thin layer of fibers in the walls of the bubbles produced on such paddle plate to spread out in a very thin layer of fibers on the plate) passes through an orifice as 145 it engages the edge of the orifice and (in being drawn through such orifices past such edges) is forcefully kneaded, with the result that the liquid in the lumen of the fibers is kneaded by engagement of the spirally formed flexible cotton fibers with the hard edge of the plates, as 142, adjacent to the orifice, as 145.

As diagrammatically shown in FIGS. 12 and 13, in each water-soaked fiber as 207 carried past a sharp rigid hole edge as 208 by the water passing through the holes as 145 the end portion, as 221, of a fiber as 207 which makes first contact with the sharp rigid edge surface is bent to one side. Thereafter, as shown in FIGS. 13 and 14, successive portions, as 222–225, initially rearward of the initially most forward portion (221), are successively similarly bent as the fiber 207 is drawn past and against the sharp edge of the hole. In such treatment the line of contact of such fiber and sharp edge of hole changes with time as the contacting portion of the fiber successively moves along the length of such fiber, as from zone 221 to zone 222 to zone 223 to zone 224 to zone 225, as shown diagrammatically in FIGS. 12–14. The resulting bending and massaging or kneading action on each fiber moves the liquid initially in the lumen of each of such hollow fibers near the ends and in the middle thereof along the otherwise collapsed lumen of the tube. Concurrent with such kneading action, the initially forward end of the fiber (221) is exposed to liquid passing through hole 145 and the lumen thereof (as 176 in FIG. 6) is filled with some of such liquor, as by capillary action, up to the point therein at which, because of distortion and stoppage of such lumen by the twisted fiber shape, further filling usually stops. In this process filling is continued when the fiber is again kneaded, which occurs frequently and rapidly because the operation of apparatus 20 provides repeated and frequent and forceful agitation of the body of liquid 110 by paddle assembly 22, consequent formation of vertically extending columns of liquid and bubbles, and repeated and frequent location of the liquid and fiber content of the bubble walls in thin films on the rapidly moving paddle surface, with repeated and frequent and forceful discharge of liquid so captured on the paddle surface through the orifices as 145, with resulting frequent and repeated and forceful kneading of the fibers against the edges of the holes and repeated and frequent moving of the liquid in the lumen of the fiber initially near one end of the fiber toward the center of the fiber and locating a solution, such as of fire retardant, such as a solution of borax 7 parts and boric acid 3 parts and water 64 parts well inside the lumen of each fiber.

The baffle 41 prevents the foam carried above axle 55 by the upwardly moving paddles of paddle assembly 50 (moving upwardly on the right side as seen in FIG. 2) in chamber 44 from passing directly to the top left (as seen in FIG. 2) portion of chamber 45 and mixing with the cotton fiber carrying foam in the top left portion of chamber 45.

The baffle 41 also prevents the fiber-carrying foam in chamber 45 carried above axle 65 by the upward moving paddles of paddle assembly 60 from passing directly to the top left portion of chamber 44 and mixing with the cotton fiber-carrying foam at top right (as seen in FIG. 2) portion of chamber 44.

The baffle 42 prevents the foam carried by the rightwardly (as shown in FIG. 2) moving paddles of paddle assembly 60 (on right side of chamber 45) from passing directly to the top left (as seen in FIG. 2) portion of compartment 46 and mixing with the cotton fiber-carrying foam in the top left portion of compartment 46. The baffle 42 also prevents the fiber carrying foam in compartments 46 carried by the leftwardly (as shown in FIG. 2) paddles in paddle assembly 70 above axle 75 from passing directly to the top right (as seen in FIG. 2) portion of compartment 45 and mixing with the cotton fiber-carrying foam at top left portion of compartment 45.

The baffle 43 prevents the foam carried above axle 85 by the leftward moving paddles of paddle assembly 80 (on left side of chamber 47) also from passing directly to the top right (as seen in FIG. 2) portion of compartment 46 and mixing with the cotton fiber-carrying foam in the top right portion of compartment 46. The baffle 43 also prevents the fiber carrying foam in compartment 46 carried above axle 75 by the paddles of paddle assembly 70 from passing directly to the top (as seen in FIG. 2) left portion of compartment 47 and mixing with the cotton fiber-carrying foam at top left portion of compartment 47.

The panels and roof forming the walls of the housing assembly transmit sound readily, although formed of 10 guage steel and rigid. Accordingly, at a fixed speed of operation of motors 101 and 105, the operation of and feed to the apparatus 20 are controlled by the sound it produces; a sound from the apparatus like heavy rain during operation of the apparatus 20 indicates that the apparatus is operating properly; heavy slug-like noises indicate not enough water is used or that the feed rate of fibers relative to the water for a given water feed rate is too heavy. Accordingly, if the sound of slugs is avoided by lowering feed rate and/or ratio of fiber to water fed to apparatus 20 at a steady speed of motors 101 and 105 an excessive fiber feed rate and pulp density are avoided and the apparatus operates smoothly. Also, the windows in the housing permit observation of undue amount of accumulation of fibers on the walls and sides of housing 40 and reduction of feed rate as needed and thereby permit continued smooth operation of the apparatus 20 at the particular feed rate of fiber used.

The process of operation of apparatus 20 accordingly includes the step of controlling the ratio of liquor to fiber in response to the sound produced by the impact of portions of the mass of said fibers against said housing assembly, whereby the (a) amount of liquor relative to the amount of fiber (b) or the rate of feed of fiber and chemical-containing aqueous liquor or (c) both (a) and (b)

is decreased when the frequency of the sound produced by masses of said fibers against said housing assembly is decreased, and is slug-like as the sound of hail on a roof and (a) the amount of liquor relative to the amount of fiber or (b) the rate of feed of fiber and liquor or (c) both (a) and (b)

is increased when the sound produced during operation of apparatus 20 has a higher pitch as the sound of rain on a roof.

I claim:

1. A process of impregnating loose cotton staple and like hollow fibers with chemicals comprising the steps of feeding a mass of such fibers into and through a series of connected compartments in a baffled housing, one pair of paddle assemblies, each said paddle assemblies being rotatable about an axle therefor, and each of said paddle assemblies comprising a plurality of paddles, located in each of said compartments and a body of chemical-containing aqueous liquor being also located in each of said compartments, said liquor at rest being located entirely below the level of the axles of said paddle assemblies, rapidly rotating said paddle assemblies in opposite directions while in contact with said body of liquor and then thereby concurrently (a) initially producing within each of the said compartments a vertically extending column comprising a frothy mass of bubbles of air separated by thin walls between said bubbles and locating such fibers in said thin walls between the bubbles of said column, (b) picking up portions of the frothy mass of fibers and liquor from the mass of bubbles and positioning the fibers in thin films of chemical-bearing liquor on the surfaces of said paddles above the level of the axles of said paddle assemblies, (c) dewatering the resulting thin films, and (d) kneading the fibers individually and locating chemicals contained in said liquor within the lumen of each of such fibers.

2. Process as in claim 1 wherein the fibers move along a flat smooth surface on a rotating paddle of a paddle assembly in a radial direction away from the axle of said paddle assembly of which said paddle is a part and are projected against a rigid surface of said housing and are there kneaded and move liquor along the length of the lumen of such fibers.

3. Process as in claim 2 wherein said step of kneading is effected by passing water from said thin films through each of a plurality of holes in said paddles in streams carrying fibers from said thin films in contact with the edges of said holes and past the edges of said holes and thereby forcefully kneading said fibers.

4. Process as in claim 3 wherein the individual fibers in the thin films on the surface of the paddles are oriented with the length of the fibers transverse to the axle of said paddle assembly.

5. Process as in claim 2 wherein the individual fibers in a thin film on the surface of the paddle are oriented with the lengths of the fibers transverse to the axle of said paddle assembly.

6. Process as in claim 5 and wherein said step of kneading is also effected by passing liquor from said thin films through each of a plurality of holes in said paddles in streams carrying fibers from said thin films in contact with the edges of said holes and past the edges of said holes and thereby forcefully kneading said fibers.

7. Process as in claim 6 wherein the ratio of liquor to fiber is controlled in response to the sound produced by the impact of portions of the mass of said fibers against said housing.

8. Process as in claim 7 wherein the amount of liquor relative to the amount of fiber is decreased when the frequency of the sound produced by masses of said fibers against said housing is decreased.

* * * * *